US006584818B2

(12) United States Patent
Bates et al.

(10) Patent No.: US 6,584,818 B2
(45) Date of Patent: Jul. 1, 2003

(54) INTERCONNECTED LOCK WITH LOCK STATUS SENSOR

(75) Inventors: Peter K. Bates, Framingham, MA (US); John Bussiere, Littleton, MA (US); Alan Doerr, Tomball, TX (US)

(73) Assignee: Schlage Lock Company, Indianapolis, IN (US)

( * ) Notice: Subject to any disclaimer, the term of this patent is extended or adjusted under 35 U.S.C. 154(b) by 0 days.

(21) Appl. No.: 09/765,785

(22) Filed: Jan. 19, 2001

(65) Prior Publication Data

US 2002/0095958 A1 Jul. 25, 2002

(51) Int. Cl.[7] ..... E05B 41/00; E05B 59/00; E05B 47/06

(52) U.S. Cl. ..... 70/432; 70/107; 70/283; 70/277; 70/DIG. 59

(58) Field of Search ..... 70/432, DIG. 59, 70/107, 278.7, 283, 279.1, 277

(56) References Cited

U.S. PATENT DOCUMENTS

| | | | | | |
|---|---|---|---|---|---|
| 897,686 | A | | 9/1908 | Voight | |
| 2,862,750 | A | | 12/1958 | Minke | |
| 3,254,518 | A | | 6/1966 | Tucker | |
| 3,621,686 | A | | 11/1971 | Klein | |
| 3,744,285 | A | | 7/1973 | Barmherzig | |
| 3,751,088 | A | | 8/1973 | Schlage et al. | |
| 3,791,180 | A | | 2/1974 | Doyle | |
| 3,910,613 | A | | 10/1975 | Nolin | |
| 3,999,789 | A | | 12/1976 | Maurits et al. | |
| 4,129,019 | A | | 12/1978 | Urdal | |
| 4,148,092 | A | * | 4/1979 | Martin | 361/172 |
| 4,237,711 | A | * | 12/1980 | Kambic | 70/150 |
| 4,276,760 | A | | 7/1981 | Nolin | |
| 4,509,347 | A | | 4/1985 | Young | |
| 4,561,684 | A | | 12/1985 | Marotto | |
| 4,634,155 | A | | 1/1987 | Geringer et al. | |
| 4,683,741 | A | * | 8/1987 | Fields | 109/38 |
| 4,765,663 | A | | 8/1988 | Raymond et al. | |
| 4,800,741 | A | | 1/1989 | Kerschenbaum et al. | |
| 4,809,526 | A | * | 3/1989 | Shen | 292/21 |
| 4,838,053 | A | | 6/1989 | Shen | |
| 4,840,050 | A | | 6/1989 | Gotanda | |
| 4,843,851 | A | | 7/1989 | Frolov | |
| 4,899,562 | A | * | 2/1990 | Gartner et al. | 70/277 |
| 4,972,694 | A | * | 11/1990 | Aulbers et al. | 70/277 |
| 4,979,383 | A | * | 12/1990 | Tully | 70/107 |
| 4,979,767 | A | | 12/1990 | Lin | |
| 4,987,968 | A | | 1/1991 | Martus et al. | |
| 5,000,018 | A | * | 3/1991 | Eisermann | 70/223 |
| 5,005,393 | A | * | 4/1991 | Ewalds et al. | 70/134 |
| 5,044,182 | A | | 9/1991 | Totten | |

(List continued on next page.)

FOREIGN PATENT DOCUMENTS

| | | |
|---|---|---|
| DE | 2026582 | 12/1971 |
| EP | 431717 A2 | 6/1991 |
| GB | 2316122 A | 2/1998 |

*Primary Examiner*—Anthony Knight
*Assistant Examiner*—Michael J. Kyle
(74) *Attorney, Agent, or Firm*—Michael Best & Friedrich LLP

(57) ABSTRACT

A sensor for an interconnected lock assembly which can sense whether the door is in a locked or unlocked state. The interconnected lock assembly comprises a first lock assembly and a second lock assembly, both operably interconnected by a rack mounted on a carrier component. The second lock assembly is operably connected to a deadbolt latch assembly which comprises a deadbolt movable between an extended position when the carrier component is in a lowered position and a retracted position when the carrier component is in a raised position. The sensor is positioned within the interconnected lock assembly to detect when the carrier component is in a lowered position or in a raised position. The information is relayed to an electronic control module.

19 Claims, 10 Drawing Sheets

U.S. PATENT DOCUMENTS 5,067,755 A 11/1991 James
5,077,992 A * 1/1992 Su ..... 292/36
5,136,870 A * 8/1992 Gartner et al. ..... 70/277
5,148,691 A 9/1992 Wallden
5,255,547 A 10/1993 Burr et al.
5,325,687 A 7/1994 Lin
5,339,662 A 8/1994 Goldman
5,421,178 A 6/1995 Hamel et al.
5,457,975 A 10/1995 Berger et al.
5,475,996 A 12/1995 Chen
5,496,082 A 3/1996 Zuckerman
5,513,505 A 5/1996 Dancs
5,513,510 A 5/1996 Solovieff et al.
5,531,086 A 7/1996 Bryant
5,537,848 A 7/1996 Grzanka et al.
5,544,507 A * 8/1996 Lin ..... 70/107
5,564,294 A * 10/1996 Chen ..... 340/328
5,611,227 A 3/1997 Solovieff
5,636,880 A 6/1997 Miller et al.
5,636,881 A 6/1997 Stillwagon
5,640,863 A 6/1997 Frolov
5,655,393 A 8/1997 Kuo et al.
5,657,653 A 8/1997 Hensley et al.
5,707,090 A 1/1998 Sedley
5,713,612 A 2/1998 Kajuch
5,787,741 A 8/1998 Shen
5,791,177 A 8/1998 Bianco
5,810,402 A 9/1998 Armstrong
5,820,177 A 10/1998 Moon
5,852,944 A 12/1998 Collard, Jr. et al.
5,862,693 A 1/1999 Myers et al.
5,881,586 A * 3/1999 Shen ..... 292/34
5,943,888 A 8/1999 Lawson
5,960,656 A 10/1999 Yao
5,979,199 A 11/1999 Elpern et al.
5,996,383 A * 12/1999 Adelmeyer et al. ..... 362/100
6,128,933 A 10/2000 Mirshafiee et al.
6,255,957 B1 * 7/2001 Sonderegger et al. ..... 340/5.32

* cited by examiner

INTERCONNECTED LOCK WITH LOCK STATUS SENSOR

TECHNICAL FIELD

This invention relates generally to interconnected lock assemblies used to secure doors. More particularly, the present invention relates to an interconnected lock assembly which provides a feature to sense whether the door is in a locked or unlocked state.

BACKGROUND OF THE INVENTION

An interconnected lock assembly is characterized by an inside handle, either knob or lever, which simultaneously retracts both a deadlatch and a deadbolt. Such a lock assembly is commonly found in public accommodations such as hotels and motels in which, for security purposes, the occupant wishes to set both a deadlatch and a deadbolt. The same type of lock assembly may also be found in a residential environment. It is particularly important that both locks be retracted by the turning of a single inside operating member as it has been found that in the event of a fire or other panic situation it is desirable that the occupant only need turn a single knob or lever to operate all of the lock mechanisms in a particular door.

Such interconnected lock assemblies have been on the market for a number of years. Some interconnected lock assemblies are adjustable to compensate for varying distances between the latch assemblies. The adjustable feature is particularly helpful if there is a slight misalignment of the latch assembly bores, or when retrofitting an existing door if the distance between bore centerlines is not the same as the distance between the latch assemblies of the interconnected lock. One prior art design discloses an adjustable interconnected lock which enables interconnection of an exterior assembly that has an adjustable spacing between the exterior dead bolt assembly and a lower lock assembly.

One problem with interconnected lock assemblies is that when leaving, the user can open the door by using just the interior handle, even if the door is locked, but must use a key to lock the door behind them. This can provide an inconvenience especially when the keys are not readily available, the user is carrying objects, the user does not have a key, or the user is in a hurry. Thus the convenience and ease of operation provided by the interconnect lock is lost.

The foregoing illustrates limitations known to exist in present interconnected lock assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is therefore an object of the present invention to provide an interconnected lock assembly which can sense whether the door is in a locked or unlocked state. This and other objects of the present invention are provided by an interconnected lock assembly mounted in a door, comprising a first lock assembly and a second lock assembly, both operably interconnected by a rack mounted on a carrier component. The second lock assembly is operably connected to a deadbolt latch assembly which comprises a deadbolt movable between an extended position when the carrier component is in a lowered position and a retracted position when the carrier component is in a raised position. The interconnected lock assembly further comprises a sensor component positioned in a predetermined manner to detect when the carrier component is in a lowered position or in a raised position.

DETAILED DESCRIPTION

Figure 1:
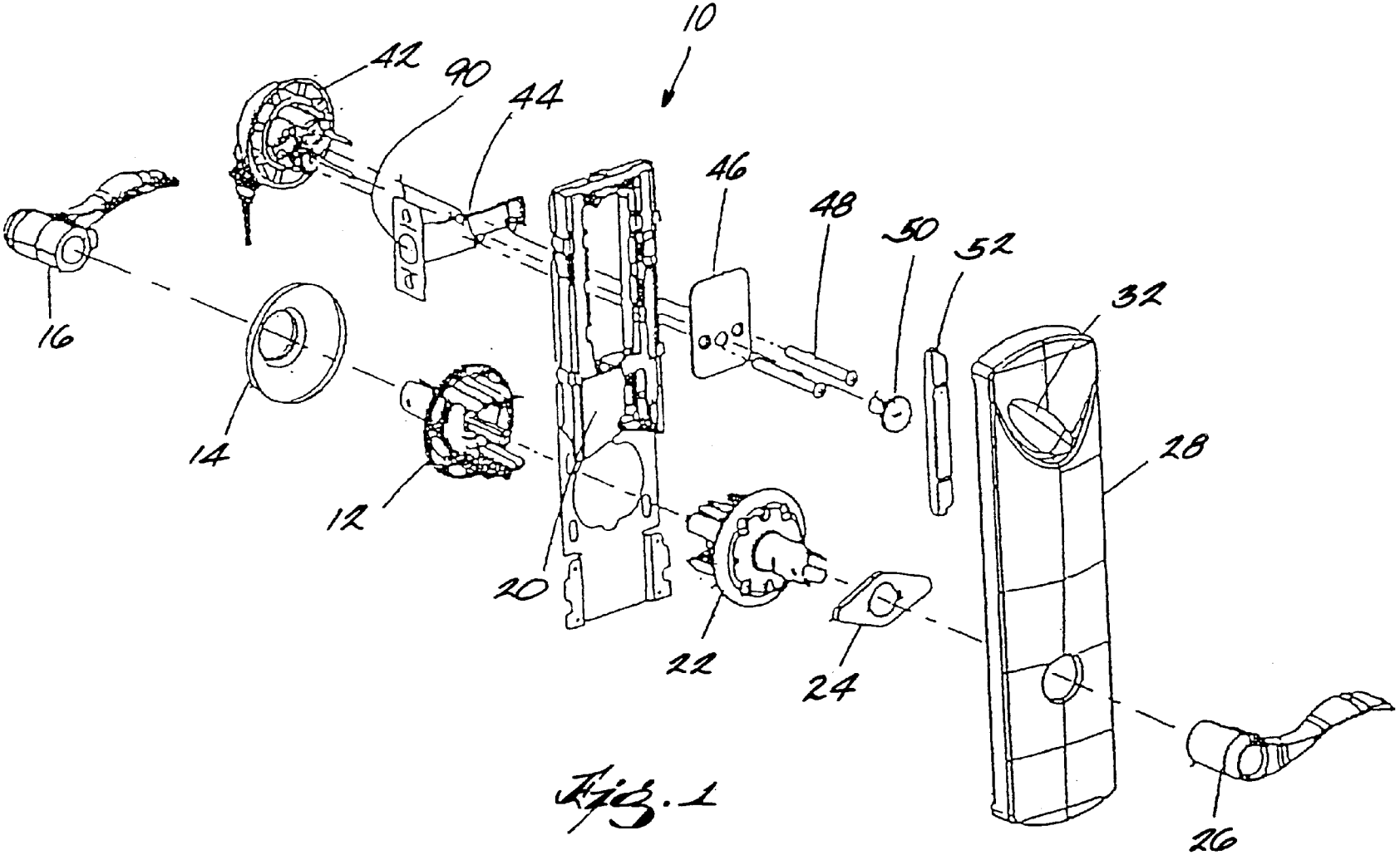
FIG. 1 is an exploded perspective view of the interconnected lock assembly of the present invention.
Figure 2:
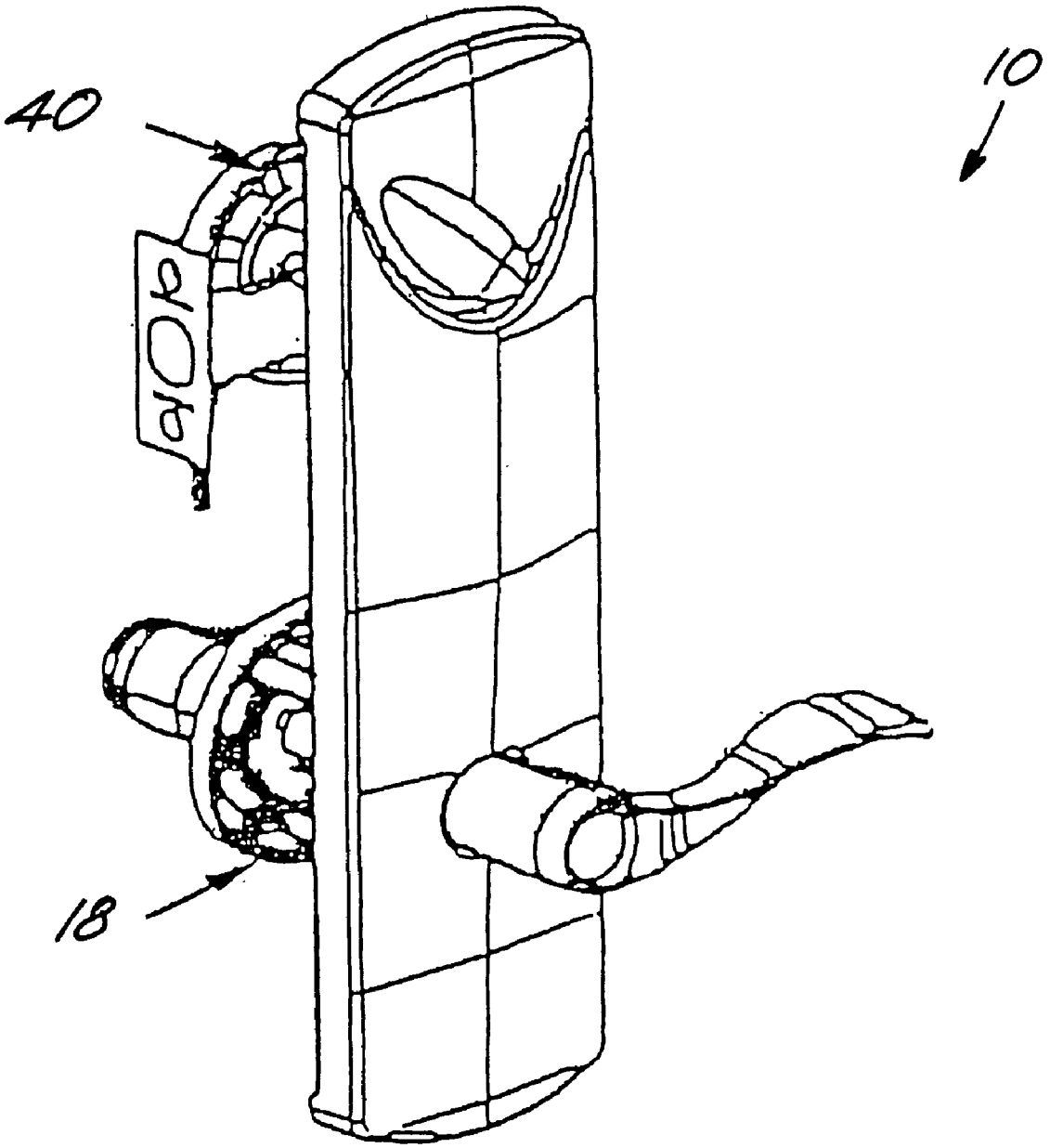
FIG. 2 is a perspective view of the assembled interconnected lock assembly in accordance with the present invention of FIG. 1.

Referring now to the drawings, wherein similar reference characters designate corresponding parts throughout the several views, there is generally indicated at 10 an adjustable interconnected lock assembly with a lock status sensor of the present invention. Referring specifically to FIGS. 1 and 2, lock assembly 10 comprises a first or lower interconnected lock assembly 18 comprising outside housing assembly 12, rose 14, and outside knob/lever 16, attached from the outside of a door (not shown) through a first or lower bore in the door, and through a back plate assembly 20 positioned on the inside of the door, to inside housing assembly 22. Interconnect cam 24, escutcheon assembly 28, and inside knob/lever 26 are attached to inside housing assembly 22 on the inside of the door. Although not shown, a latch assembly could be operably connected between outside housing assembly 12 and inside housing assembly 22. Interconnected lock assembly 10 also comprises a second or upper interconnected lock assembly 40 comprising a deadbolt housing assembly 42 and a deadbolt latch assembly 44. Deadbolt housing assembly 42 is attached from the outside of the door through a second or upper bore and operably connected to deadbolt latch assembly 44, and through back plate assembly 20 and secured thereto by deadbolt plate 46 and mounting screws 48. Deadbolt housing assembly 42 is operably connected to a deadbolt pinion 50 which engages a deadbolt rack 52 connected to back plate assembly 20 as discussed in detail below. The lower interconnected lock 18 and upper interconnected lock 40 are standard configurations that are well-known in the art, and as such, the workings of these locks will not be described in detail, except as they relate to the present invention.

Figure 3:
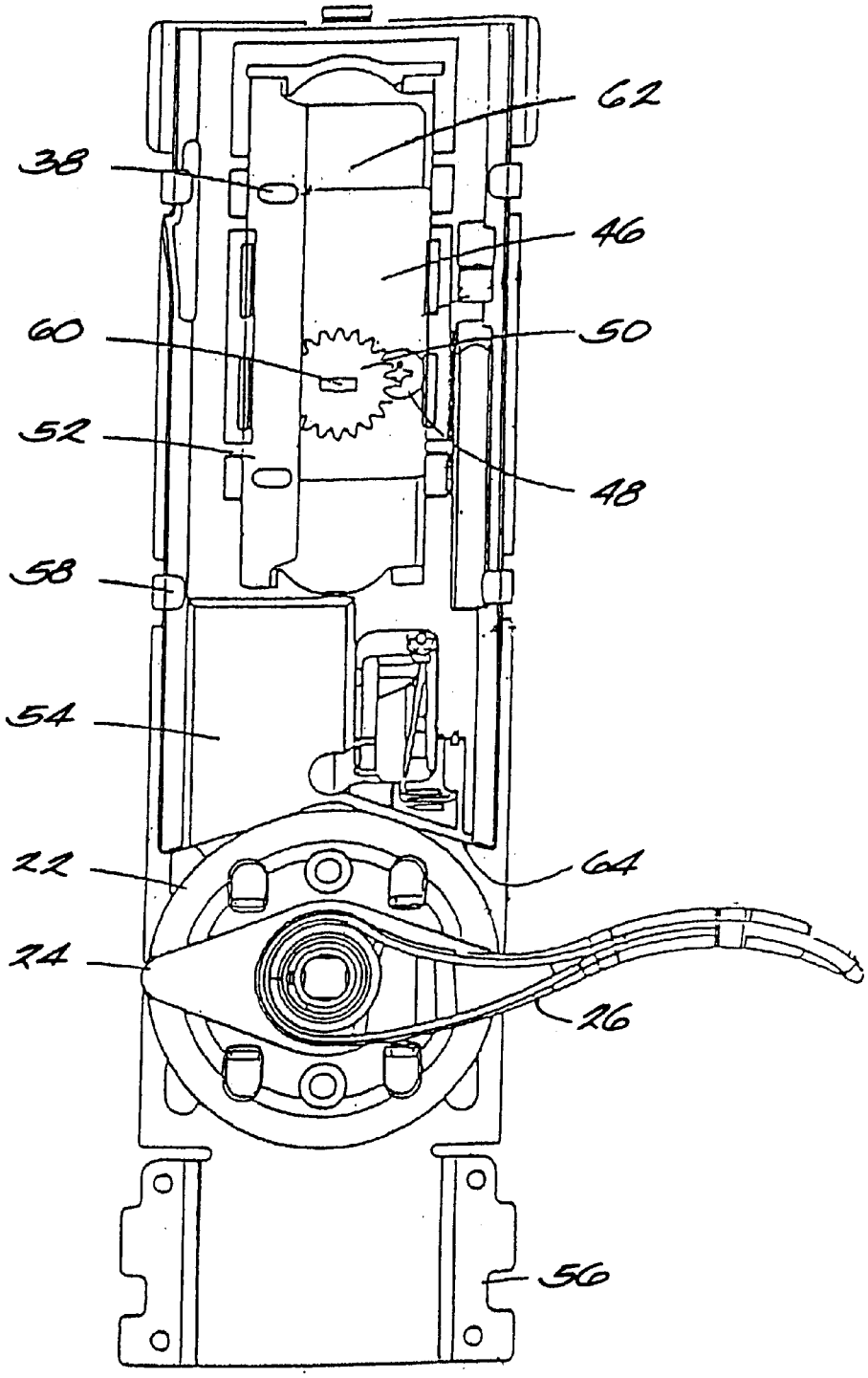
FIG. 3 is a side elevational view of the assembled interconnected lock assembly, shown without the escutcheon assembly, in accordance with the present invention.
Figure 7A:
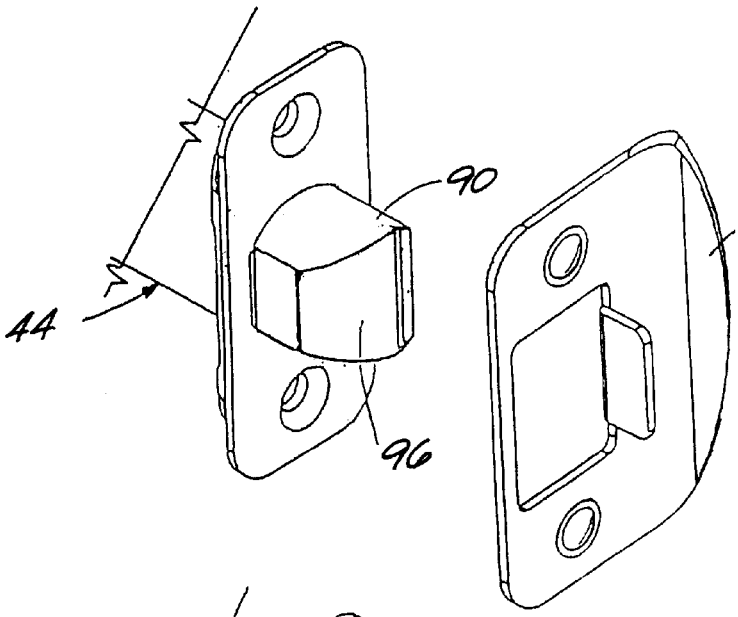
FIG. 7A is an partially exploded perspective view of the deadbolt latch assembly and strike plate showing the deadbolt in an extended position.
Figure 7B:
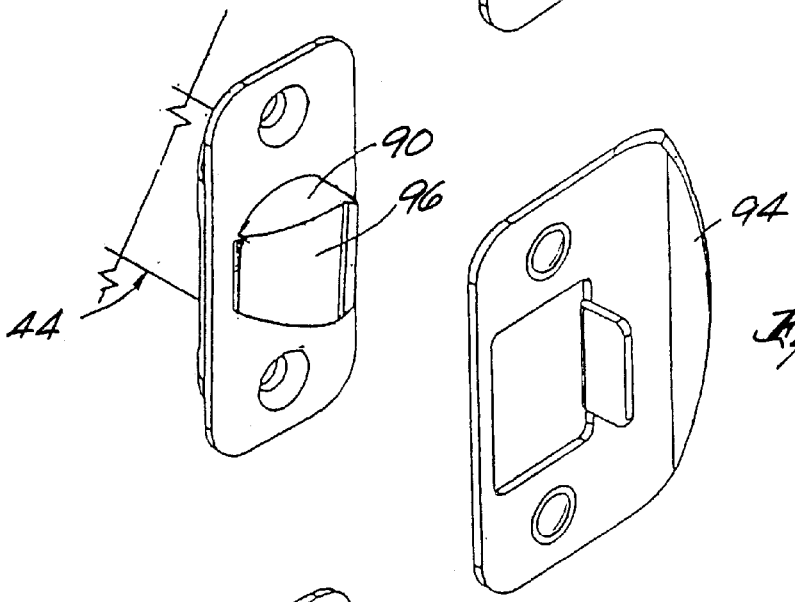
FIG. 7B is an partially exploded perspective view of the deadbolt latch assembly and strike plate showing the deadbolt in a partially extended position.
Figure 7C:
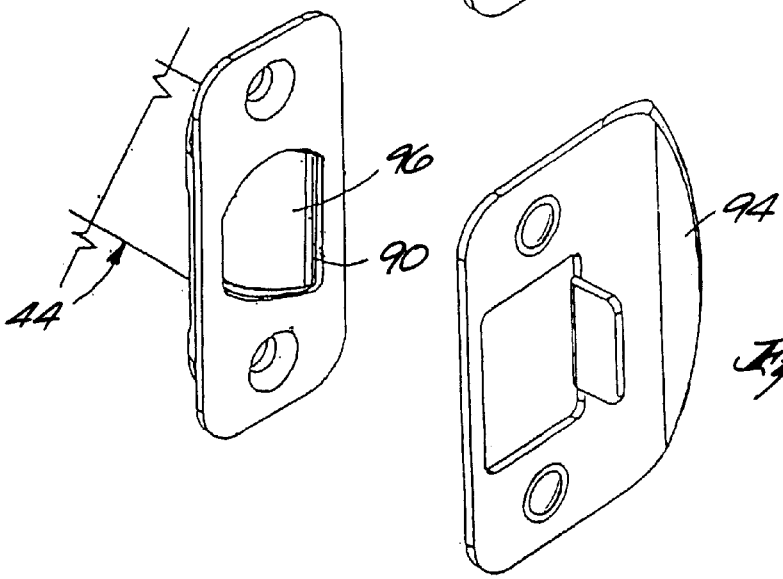
FIG. 7C is an partially exploded perspective view of the deadbolt latch assembly and strike plate showing the deadbolt in a retracted position.

Referring now to FIG. 3, interconnected lock 10 shown with escutcheon assembly 28 removed. Back plate assembly 20 comprises a carrier component 54 vertically movable on, and slidably attached to a back plate 56 by a plurality of tangs 58. Deadbolt rack 52 is oriented vertically and fixedly attached to carrier component 54 such that it engages pinion 50. Interconnected lock 10 is adjustable in that upper lock assembly 40 can move up or down to properly fit the upper bore of the door. Deadbolt plate 46 is movable within a slot 62 in back plate 56 to allow the proper positioning of upper lock assembly 40. Upper lock assembly 40 is then secured to deadbolt plate 46 by mounting screws 48 which secure upper lock assembly 40 in a fixed position. Deadbolt assembly 42 is operably connected to deadbolt pinion 50 by a driver bar 60 which is co-rotatingly attached to deadbolt pinion 50. Carrier component 54 is shown in a raised, or unlock position. When carrier component 54 is in a lowered, or locked position, a mating cam surface 64 of carrier component 54 engages cam 24. Cam 24 is attached to knob/lever 26 in a co-rotating manner such that rotation of knob/lever 26 rotates cam 24 which engages mating cam surface 64, causing carrier component 54 to move vertically, upwardly to a raised, or unlock position. The rack 52 attached to carrier component 54 causes deadbolt pinion 50 to rotate as carrier component 54 moves either upward or downward. Driver bar 60 co-rotates with deadbolt pinion 50. Rotation of driver bar 60 causes retraction and extension of deadbolt 90 of deadbolt latch assembly 44 in a standard fashion. Accordingly, as carrier component 54 moves upward, deadbolt 90 of deadbolt latch assembly 44 is retracted, allowing the door to be opened. Deadbolt 90 is shown in an extended position and a retracted position in FIGS. 7A and 7C, respectively. Deadbolt 90 is distinguished from standard deadbolts in that deadbolt 90 includes a cam surface 96 at a distal end. While cam surface 96 is similar to cam surfaces used in standard spring latch assemblies, cam surface 96 only partially extends along the extended deadbolt 90 as best shown in FIG. 7C. Accordingly, the door cannot be closed when the deadbolt 90 is in an extended position. However, when the deadbolt 90 is partially extended in a manner that cam surface 96 is configured as shown in FIG. 7B, the door can be closed as cam surface 96 will engage strike plate 94, forcing deadbolt 90 to retract. It should be noted depression of deadbolt 90 of deadbolt latch 44 rotating deadbolt pinion 50 in a standard manner, moving carrier component 54 to a raised position.

Figure 4A:
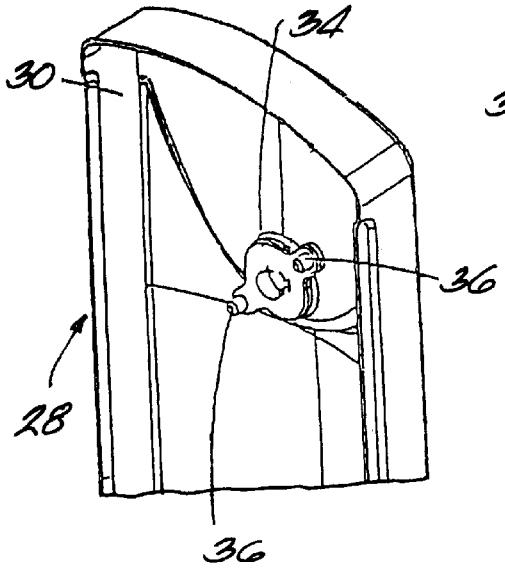
FIG. 4A is an rearward perspective view of the escutcheon assembly, in accordance with the present invention.
Figure 4B:
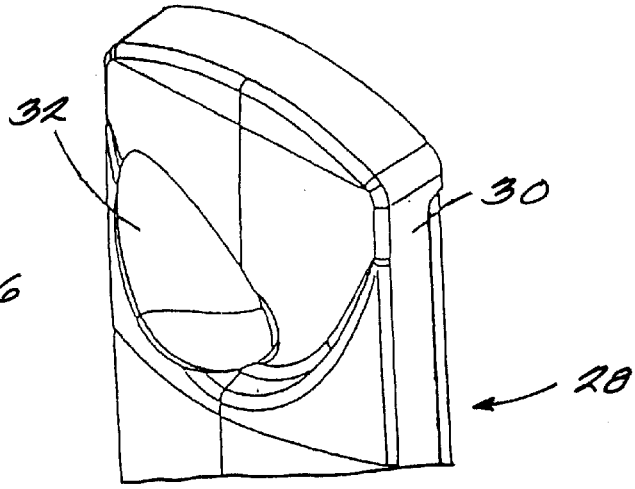
FIG. 4B is an frontal perspective view of the escutcheon assembly, in accordance with the present invention.

Referring now to FIGS. 4A and 4B, escutcheon assembly 28 comprises escutcheon 30, thumbturn 32, and thumbturn link component 34. Thumbturn 32 is coupled to thumbturn link component 34 in a co-rotating manner through an aperture in escutcheon 30. Thumbturn link component 34 comprises at least one pin 36 which engages an aperture 38 in rack 52, linking thumbturn 32 to carrier component 54. It is noted that rack 52 can be positioned on either side of carrier component 54 such that a pin 36 will engage an aperture 38 in rack 52, allowing thumbturn 32 to be appropriately attached for right and left-hand opening doors. Movement of the carrier component 54 results in rotation of thumbturn 32, and conversely, rotation of thumbturn 32 causes movement of carrier component 54 and extension and retraction of said deadbolt 90.

Figure 5:
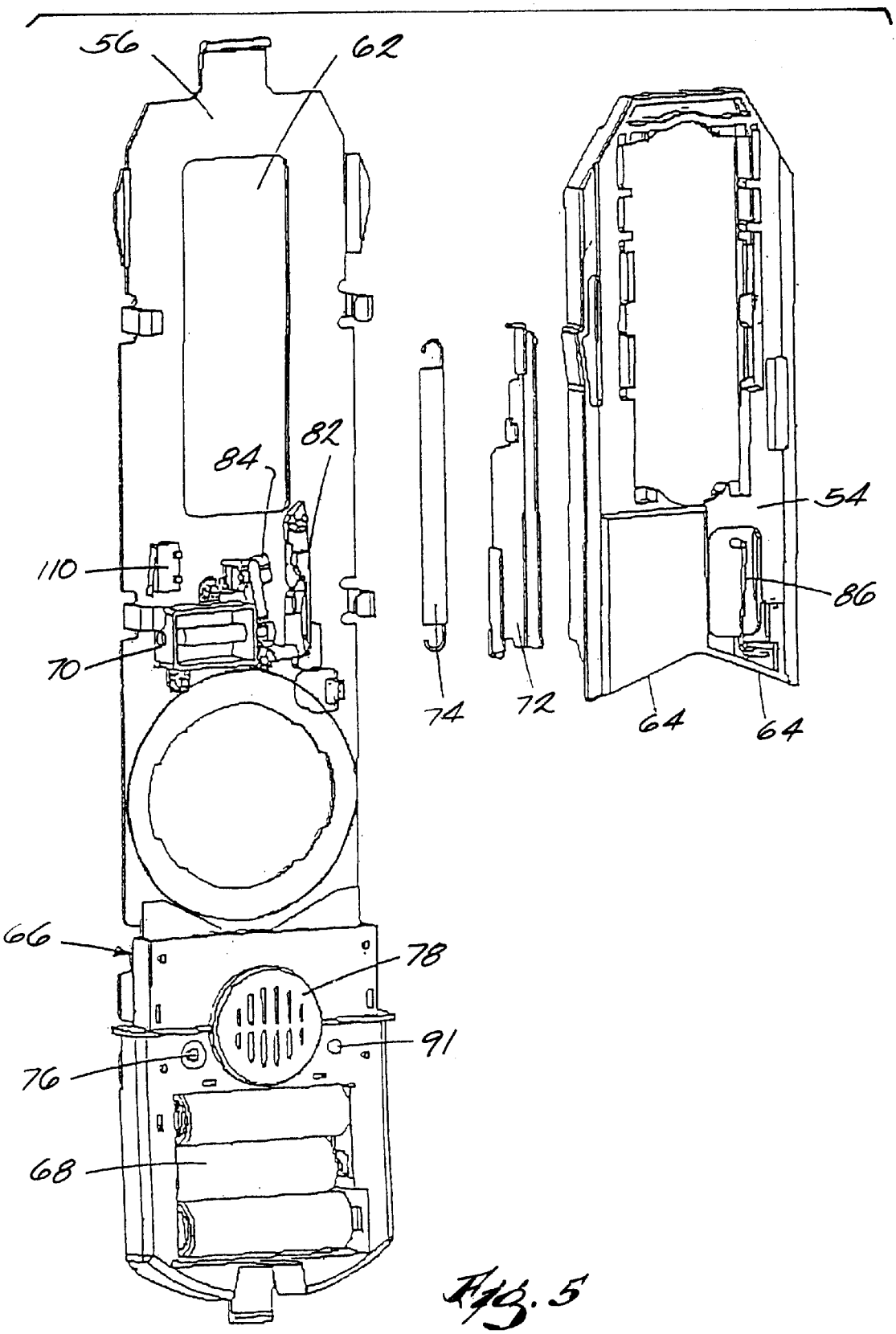
FIG. 5 is an exploded perspective view of the backplate assembly in accordance with the present invention.
Figure 10:
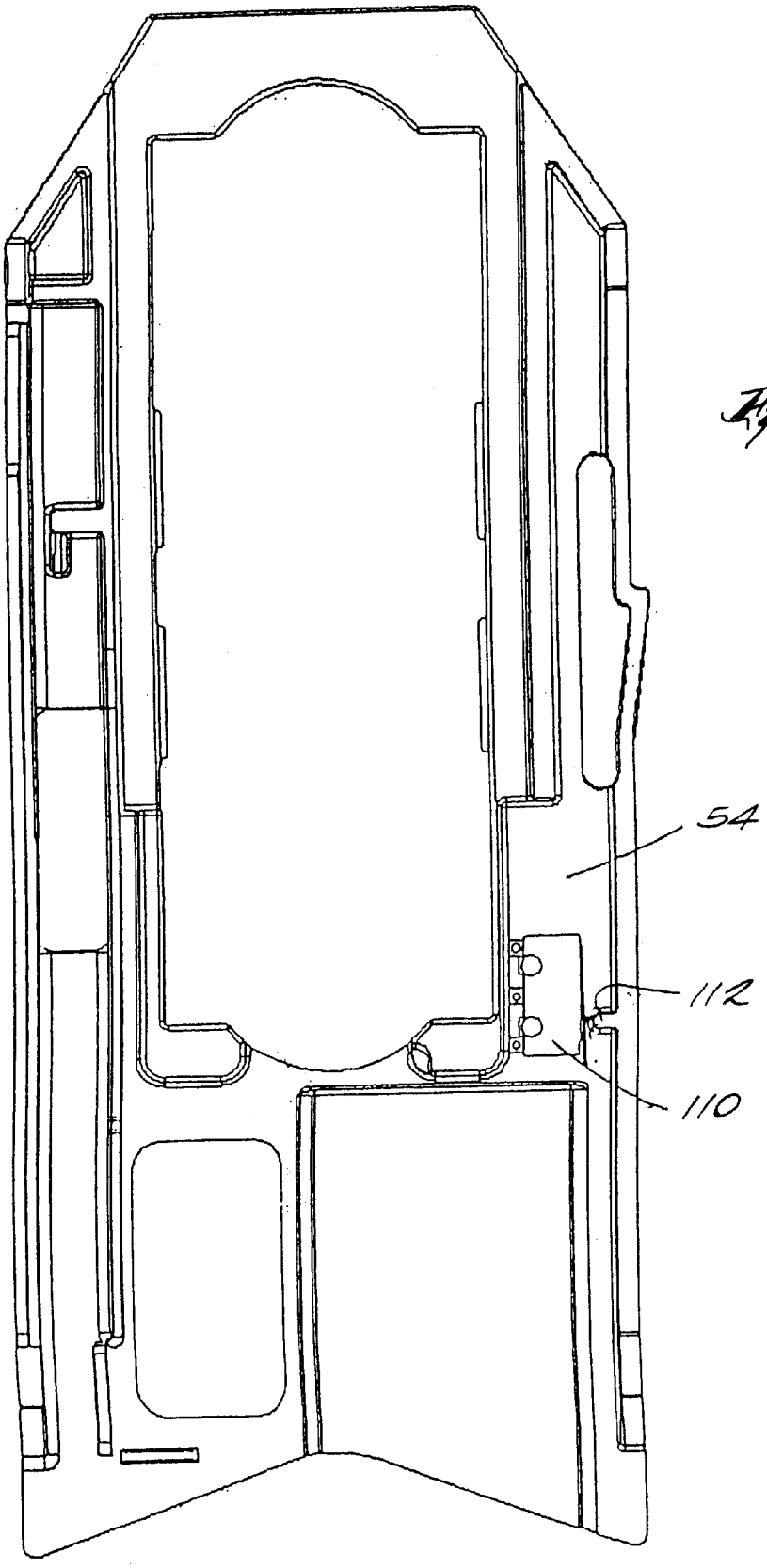
FIG. 10 is a side elevational view taken outward from said backplate including only the carrier component and sensor component showing the carrier component in a door locked position.
Figure 11:
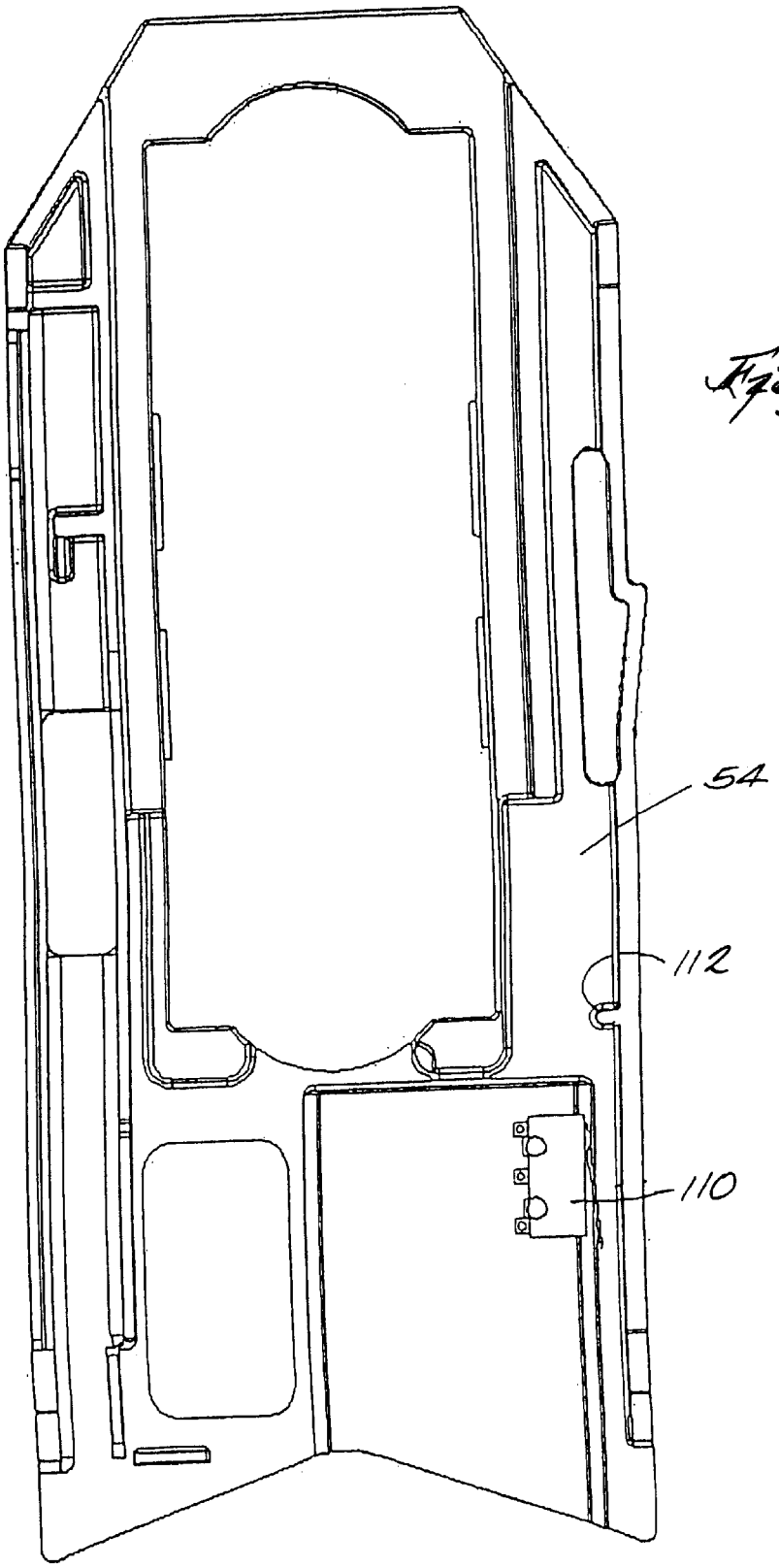
FIG. 11 is a side elevational view taken outward from said backplate including only the carrier component and sensor component showing the carrier component in a door locked position.

Referring now to FIG. 5, the back plate assembly 20 is shown in greater detail. To enable a remote locking function, interconnected lock 10 utilizes carrier component 54 which is biased in a downward, or locked position. Accordingly, a spring carriage 72 is attached to carrier component 54. Spring carriage 72 houses a spring 74 such that one end of spring 74 is attached to the assembled spring carriage 72/carrier component 54 and the other end of spring 74 is fixedly attached to back plate 56. Spring 74 is of sufficient strength to cause carrier component 54 to move downward to locked position and cause extension of deadbolt 90 of deadbolt latch assembly 44. Backplate assembly 20 further comprises an electronic module 66 housing a power component 68 shown as a plurality of batteries to operate an automatic locking solenoid 70 and a signal receiver 75. Backplate assembly 20 also comprises a sensor component 110, shown herein as, but not limited to, a microswitch. Microswitch 110 determines whether the attached carrier component 54 is in a locked position as shown in FIG. 10, or an unlocked position as shown in FIG. 11. Carrier component 4 includes an extension portion 112 which closes micro switch 110 when the carrier component 54 is in a locked position. When camer component 54 moves upward, extension portion 112 moves, opening microswitch 110. Microswitch 110 relays the locked or unlocked status of interconnected lock assembly 10 to electronic module 66. Electronic module 66 may also be used to power a speaker 78 which can verbally (or with predetermined beeps) give the locked status of the door at predetermined times such as upon closing the door, opening the door, after unlocking the door, or upon receiving a signal from a remote operating device 98. Electronic module 66 may also comprise status lights 91 indicating a color corresponding to the locked or unlocked status of interconnected lock assembly 10. When the lock 10 is in an unlocked condition, electronic module 66 may prevent operation of automatic locking solenoid 70 and/or transmit a status signal to remote operating device 98.

Figure 6A:
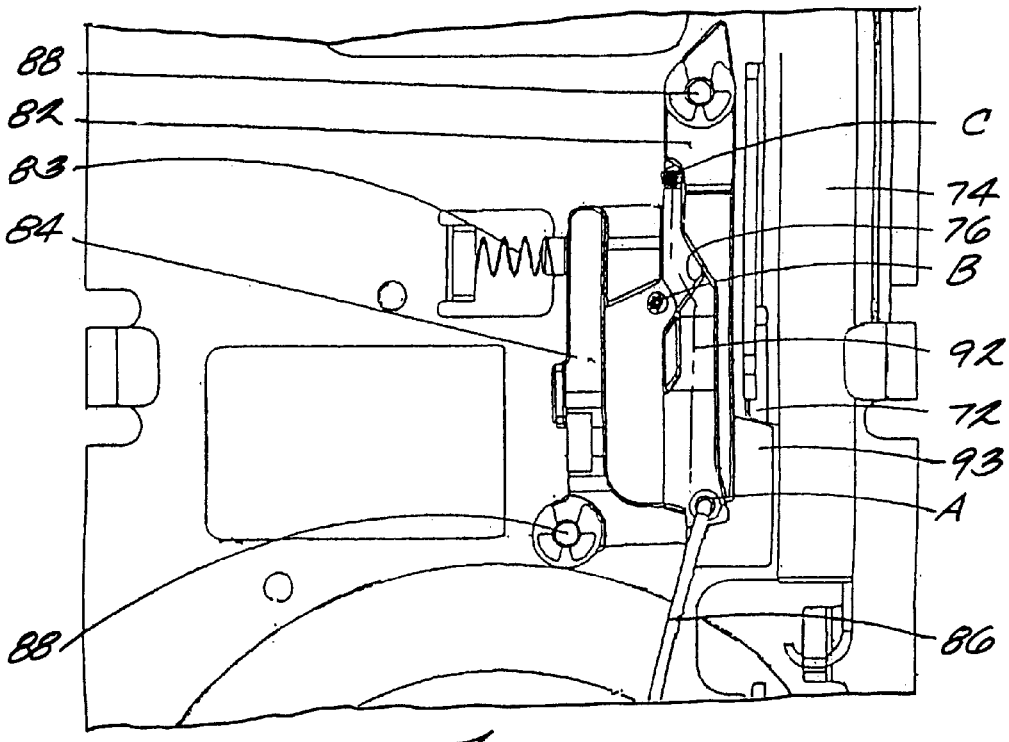
FIG. 6A is a partial side elevational view of the backplate assembly with the carrier component removed and the remote locking solenoid removed, showing the catch mechanism components.
Figure 6B:
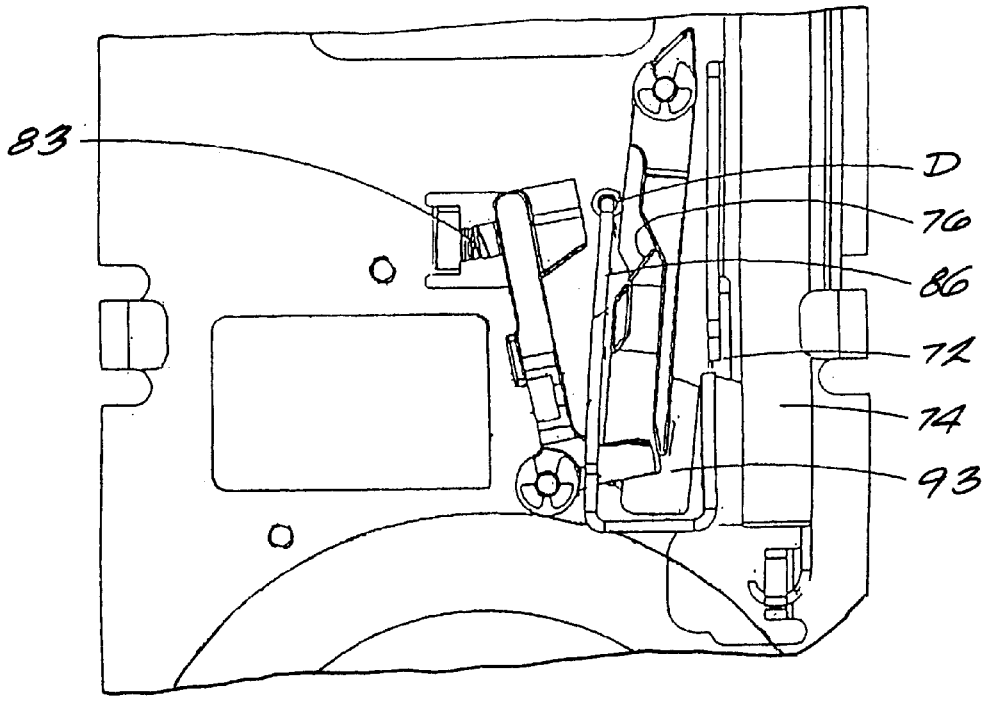
FIG. 6B is a partial side elevational view of the backplate assembly with the carrier component removed and the remote locking solenoid removed, revealing the catch mechanism in a disengaged catch position.

In order to prevent spring 74 from returning carrier component 54 to a locked position, back plate assembly includes a catch mechanism 80 comprising a catch component 82, a catch release 84, and a spring trigger rod 86 as shown in FIGS. 6A and 6B. Catch component 82 and catch release 84 are each pivotally attached to back plate 56 by a pin 88. Catch release 84 is biased toward catch component 82 by catch release spring 83. Spring trigger rod 86 is affixed to carrier component 54 and moves along a guide portion 92 in catch component 82. Spring trigger rod 86 is also biased toward spring 74.

The operation of interconnected lock 10 is best described in a dynamic manner starting with carrier component 54 position in a lowered, or locked position. Interconnected lock 10 includes a keyless exit feature that enables automatic locking actuation. Movement of carrier component 54 from a locked position to an unlocked position can be accomplished by either rotating inside knob/lever 26, rotating thumbturn 32, or by turning a key to rotate the rotating driver bar 60 of deadbolt assembly 42, typically with a key. As carrier component 54 moves upward, spring trigger rod 86 moves upward along guide portion 92 of catch component 82 from its initial position A, shown in FIG. 6A. Movement of carrier component 54 and attached rack 52 causes rotation of pinion 50 and driver bar 60, retracting deadbolt 90 of deadbolt latch assembly 44. At the end of the carrier component 54 travel, the deadbolt 90 of deadbolt latch assembly 44 is fully retracted. Spring trigger rod 86, now at position C, and catch release 84, biased by catch release spring 83, force a tab feature 93 of catch 82 to move underneath spring carriage 72 in a manner locking carrier component 54 in an unlocked position. Spring 74 is now in an extended position, storing energy needed to extend the deadbolt 90. At this point, further opening and closing of the door will not affect catch mechanism 80 as the guide path of the spring trigger rod 86 does not release the spring carriage 72. Spring trigger rod 86 will move upward from position A to position C along guide path 92 of catch component 82. When carrier component 54 moves downward, trigger spring rod 86 will move downward from position C, through position B, back to position A. Spring trigger rod 86 deviates from guide path 92 in the downward direction. Guide path 92 of catch component 82 is configured with a ramp portion between lowered portions generally corresponding to positions A and C. Between positions A and C, trigger spring rod 86 moves up a ramp portion to a drop-off 76 shown generally adjacent to position B. In the downward direction, spring trigger rod 86 is forced by the wall of drop-off 76 to move off of catch component 82 to a position below a portion of catch release 84. In normal operation of the lock 10, spring trigger rod 86 will continue downward from position B and return to position A. Accordingly, standard operation of the lock does not affect the catch mechanism.

In order to actuate the keyless exit feature, when deadbolt 90 of deadbolt latch assembly 44 is retracted, thumbturn 32 is rotated to an intermediate position. Rotation of thumbturn 32 causes thumbturn link component 34 to rotate. At least one pin 36 of thumbturn link component 34 engages rack 52, such that rotation of thumbturn 32 causes carrier component 54 to move partially downward, partially extending deadbolt 90 of deadbolt latch assembly 44. In addition, spring trigger rod 86 moves from position C to a position adjacent catch release 84, shown as position B.

Referring now to FIG. 6B, operation of the keyless exit feature is shown. The deadbolt 90 is in a partially extended position such as that shown in FIG. 7B. When cam surface 96 of deadbolt 90 is driven back by a strike plate 94 of the door jamb (not shown) such as when the door is closed, linear movement of deadbolt 90 within deadbolt latch assembly 44 is converted to rotation of deadbolt pinion 50 in a standard manner. Rotation of deadbolt pinion 50 causes carrier component 54 to move upward, moving spring trigger rod 86 to position D, forcing catch release 84 to rotate and free catch 82. This action allows spring carriage 74/carrier component 54 to move downward under the force of spring 72. As carrier component 54 moves downward, the deadbolt 90 of deadbolt latch assembly 44 is fully extended via the interaction of the deadbolt pinion 50 and rack 52.

When the keyless exit function is not in use, interconnected lock 10 will operate as a normal, or standard, interconnected lock.

Figure 9:
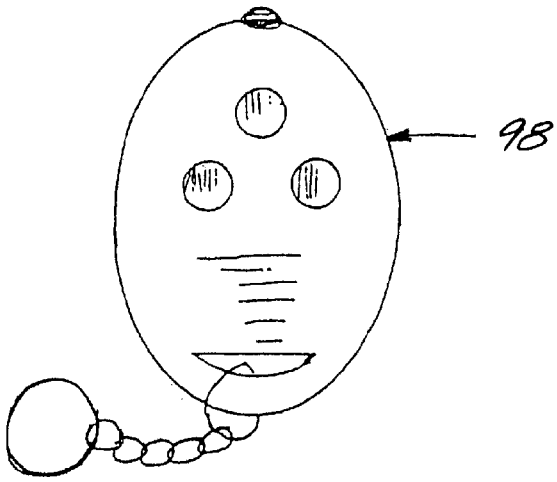
FIG. 9 is a top plan view of the remote locking transmitter used with the remote locking mechanism.
Figure 8B:
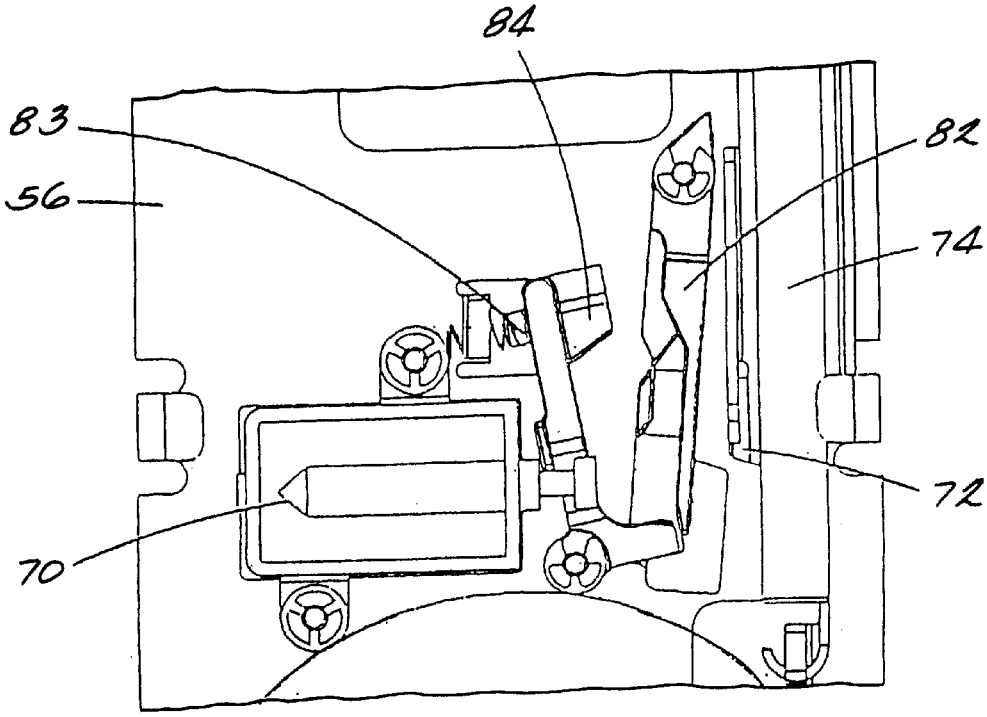
FIG. 8B is a partial side elevational view of the backplate assembly with the carrier component removed, revealing the remote locking mechanism in a disengaged catch position.
Figure 8A:
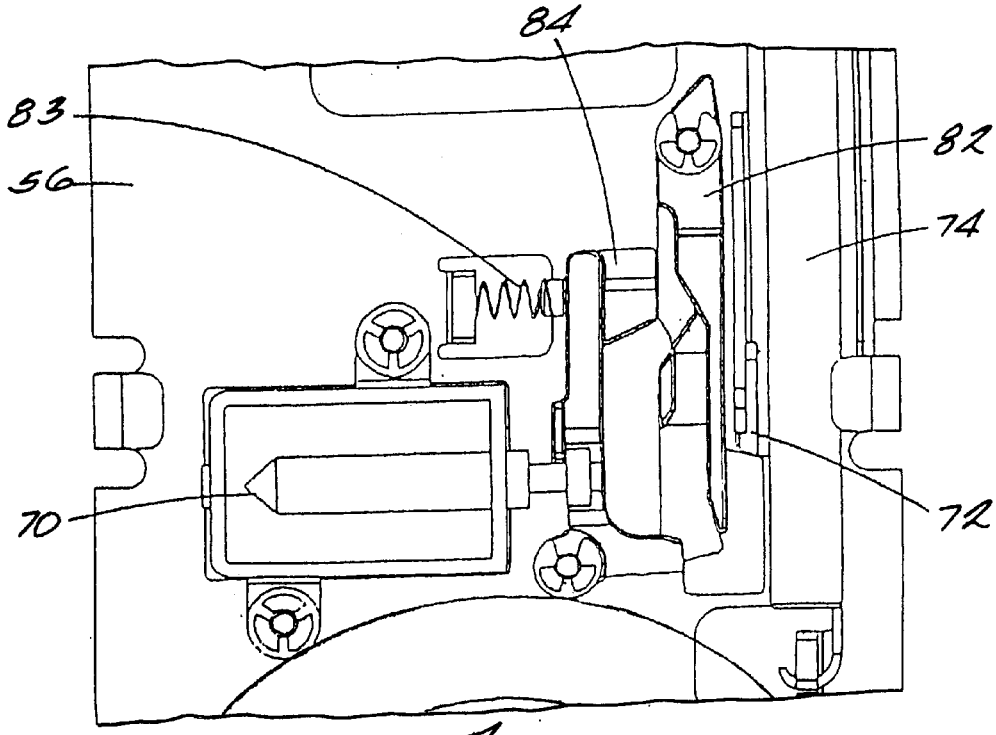
FIG. 8A is a partial side elevational view of the backplate assembly with the carrier component removed, revealing the remote locking mechanism components.

The remote locking feature utilizes solenoid 70 operably connected to catch release 84 as shown in FIG. 8A. A remote signal device 98 is utilized with the remote locking mechanism, shown in FIG. 9 as a standard keychain transmitter of the type used to unlock cars, garages, etc., When the remote locking signal is received by signal receiver 75, solenoid 70 retracts catch release 84, allowing catch component 82 to rotate away from spring carriage component 72, as shown in FIG. 8B. Carrier component 54 is then permitted to move downward under the biasing force of spring 74. As previously described, downward movement of carrier component 54 causes extension of deadbolt 90 of deadbolt latch assembly 44, thus locking the door.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. An interconnected lock assembly mounted in a door, comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a catch that pivots to hold and to maintain said carrier component in a raised position; and a sensor component positioned in a predetermined manner to detect when said carrier component is in a lowered position or in a raised position.

2. The interconnected lock assembly of claim 1, wherein said carrier component has at least one extension positioned to be detected by said sensor component when said carrier component is in a lowered position.

3. The interconnected lock assembly of claim 2, wherein said sensor component is a microswitch.

4. The interconnected lock assembly of claim 3, wherein said at least one extension engages said microswitch when said carrier component is in a lowered position.

5. The interconnected lock assembly of claim 3, wherein said at least one extension disengages said microswitch when said carrier component moves from a lowered position to a raised position.

6. The interconnected lock assembly of claim 1 further comprising an electronic control module electrically connected to said sensor component.

7. An interconnected lock assembly mounted in a door, comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a catch that pivots to hold said carrier component in a raised position; and a sensor component positioned in a predetermined manner to detect when said carrier component is in a lowered position or in a raised position; and an electronic control module electrically connected to said sensor component, wherein said electronic control module comprises at least one light indicating the lock status as either locked or unlocked in a predetermined manner based upon the position of said carrier component.

8. An interconnected lock assembly mounted in a door, comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a catch that pivots to hold said carrier component in a raised position; and a sensor component positioned in a predetermined manner to detect when said carrier component is in a lowered position or in a raised position; and an electronic control module electrically connected to said sensor component, wherein said electronic control module further comprises at least one speaker indicating the lock status as either locked or unlocked in a predetermined manner based upon the position of said carrier component.

9. The remote locking mechanism of claim 6, wherein said electronic control module further comprises a power source.

10. The remote locking mechanism of claim 9, wherein said power source comprises at least one battery.

11. An interconnected lock assembly mounted in a door, comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a biasing component biasing said carrier component toward a lowered position;

a catch positionable to hold and to maintain said carrier component in said raised position;

a sensor component positioned in a predetermined manner to detect when said carrier component is in a lowered position or in a raised position; and an electronic control module operably attached to a solenoid that selectively disengages said catch component allowing said carrier component to move to a lowered position.

12. The interconnected lock assembly of claim 11, wherein said sensor relays said detected position of said carrier component to said electronic control module.

13. The interconnected lock assembly of claim 11, wherein said electronic control module prevents engagement of said solenoid when said sensor detects said carrier component is in a raised position.

14. The interconnected lock assembly of claim 11, wherein said carrier component has at least one extension positioned to be detected by said sensor component when said carrier component is in a lowered position.

15. The interconnected lock assembly of claim 14, wherein said sensor component is a microswitch.

16. The interconnected lock assembly of claim 15, wherein said at least one extension engages said microswitch when said carrier component is in a lowered position.

17. The interconnected lock assembly of claim 15, wherein said at least one extension disengages said microswitch when said carrier component moves from a lowered position to a raised position.

18. An interconnected lock assembly mounted in a door comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a biasing component biasing said carrier component toward a lowered position;

a catch positionable to hold said carrier component in said raised position;

a sensor component positioned in a predetermined manner to detect when said carrier component is in a lowered position or in a raised position; and an electronic control module operably attached to a solenoid, said solenoid selectively engageable to disengage said catch component allowing said carrier component to move to a lowered position, wherein said electronic control module comprises at least one light indicating the lock status as either locked or unlocked in a predetermined manner based upon the position of said carrier component.

19. An interconnected lock assembly mounted in a door comprising:

a first lock assembly and a second lock assembly, both operably interconnected by a rack mounted on a carrier component, wherein said second lock assembly is operably connected to a deadbolt latch assembly, said deadbolt latch assembly comprising a deadbolt movable between an extended position when said carrier component is in a lowered position and a retracted position when said carrier component is in a raised position;

a biasing component biasing said carrier component toward a lowered position;

a catch positionable to hold said carrier component in said raised position;

a sensor component positioned in a predetermined manner to detect when said carrier component is in a lowered position or in a raised position; and an electronic control module operably attached to a solenoid, said solenoid selectively engageable to disengage said catch component allowing said carrier component to move to a lowered position, wherein said electronic control module further comprises at least one speaker indicating the lock status as either locked or unlocked in a predetermined manner based upon the position of said carrier component.

* * * * *